US005364261A

United States Patent [19]

Huang

[11] Patent Number: 5,364,261

[45] Date of Patent: Nov. 15, 1994

[54] SAFETY DEVICE FOR A LIGHTER

[76] Inventor: Yiang F. Huang, No. 2, Lane 22, Sec. 2, Shan Hsi Rd., Taichung, Taiwan, Prov. of China

[21] Appl. No.: 142,916

[22] Filed: Oct. 29, 1993

[51] Int. Cl.[5] ..... F23D 11/36

[52] U.S. Cl. ..... 431/153; 431/277

[58] Field of Search ..... 431/153, 277, 344, 255; 222/153, 402.11

[56] References Cited

U.S. PATENT DOCUMENTS

| | | | |
|---|---|---|---|
| 5,090,893 | 2/1992 | Floriot | 431/153 |
| 5,165,886 | 11/1992 | Frigiere | 431/153 |
| 5,186,618 | 2/1993 | Shike et al. | 431/153 |
| 5,205,729 | 4/1993 | Iwahori | 431/153 |
| 5,242,297 | 9/1993 | Cirami | 431/153 |

*Primary Examiner*—Carl D. Price

*Attorney, Agent, or Firm*—Collier, Shannon, Rill & Scott

[57] ABSTRACT

A lighter includes a container, a base mounted on top of the container and having a nozzle mounted in a first end thereof and a second end, a cap mounted above the base for pivotally mounting a lever member which has a first end for engaging with the nozzle and a second end on which the user may press to operate the nozzle. The lever member further includes a safety piece extending downwardly from an underside of the second end thereof and having a first beveled surface facing the first end thereof, an L-shaped engaging member having a horizontal section laterally projecting from each of two sides of the first end thereof and each vertical section of the engaging member extending downwardly from the horizontal section and having a second beveled surface facing the second end of the lever member. A safety member is mounted between the base and the cap and includes a substantially U-shaped pressing section whose mediate section is received in a spaced defined between the base and the cap, a stop is formed on each of the pair of parallel ends of the pressing section, each of the stops having a third beveled surface facing the pressing section for engaging with the first beveled surface of the safety piece to prevent from downward movement of the second end of the lever member until a lateral force is applied to the pressing section of the safety member.

1 Claim, 3 Drawing Sheets

SAFETY DEVICE FOR A LIGHTER

BACKGROUND OF THE INVENTION

1. Field of the Invention

The present invention relates to a safety device for a lighter, and more particularly for a disposable lighter.

2. Description of Related Art

Disposable lighters are now a popular article as being extremely cheap. However, as having no safety device, the disposable lighters risk gas leakage which may cause fires or injuries to the users as inhaling the gas, especially in the case that children play them for fun. The present invention provides a safety device to solve this problem.

SUMMARY OF THE INVENTION

A lighter generally includes a container for containing liquefied gas therein, a base mounted on top of the container to seal the latter and having a nozzle mounted therein with a nozzle head protruding upwardly therefrom to control the supply of the liquefied gas, a cap mounted above the base and including a pair of ears for rotatably mounting a flint wheel, and a lever means pivotally mounted to the ears and having a first end engaging with the nozzle head and a second end on which the user may press to pull the nozzle head upwardly.

The base further includes a compartment formed in a second end thereof opposite to a first end thereof where the nozzle locates, a block formed in the compartment, and a recess formed in the second end of the base and communicating with the top of the compartment. The lever means includes a safety piece extending downwardly from an underside of the second end thereof and having a first beveled surface facing the first end of the lever means. The lever means further includes an L-shaped engaging member having a horizontal section laterally projecting from each of two sides of the first end thereof, each vertical section of the engaging member extends downwardly from the horizontal section and having a second beveled surface facing the second end of the lever means. The cap includes a passage formed in one end thereof for communicating with the compartment and a second recess in an underside of said end.

A safety member is mounted between the base and the cap and includes a substantially U-shaped pressing section whose mediate section is received in the recess in the base and the recess in the cap, a stop is formed on each of the pair of parallel ends of the pressing section. Each stop has a third beveled surface facing the pressing section for engaging with the first beveled surface of the safety piece. A flexible member projects downwardly from the pressing section for cooperating with the block in the compartment to provide a returning force for the safety member. A yoke member extends from each end of the U-shaped pressing section and has a distal end with a fourth beveled surface facing opposite to the pressing section.

In a normal position of the lighter, the flexible member contacts with the block, the first beveled surface contacts with the third beveled surfaces of the stops, and the second beveled surfaces contact with the fourth beveled surfaces, thereby prohibiting downward movement of the second end of the lever means, and thus preventing from gas leakage.

If the user wants to use the lighter, he may urge the safety member to move laterally toward the first end of the lever means upon laterally pressing the pressing section (the engaging relationship between the second and fourth beveled surfaces allows such lateral movement), such that the third beveled surfaces disengage from the first beveled surface, allowing downward movement of the second end of the lever means to perform the normal lighter function when in cooperation with rotation of the flint wheel. During the lateral movement of the safety member, the flexible member is compressed in order to return the safety member back to its normal position after the downward pressing force on the second end of the lever means is removed.

Other objects, advantages, and novel features of the invention will become more apparent from the following detailed description when taken in conjunction with the accompanying drawings.

DESCRIPTION OF THE PREFERRED EMBODIMENTS

Figure 1:
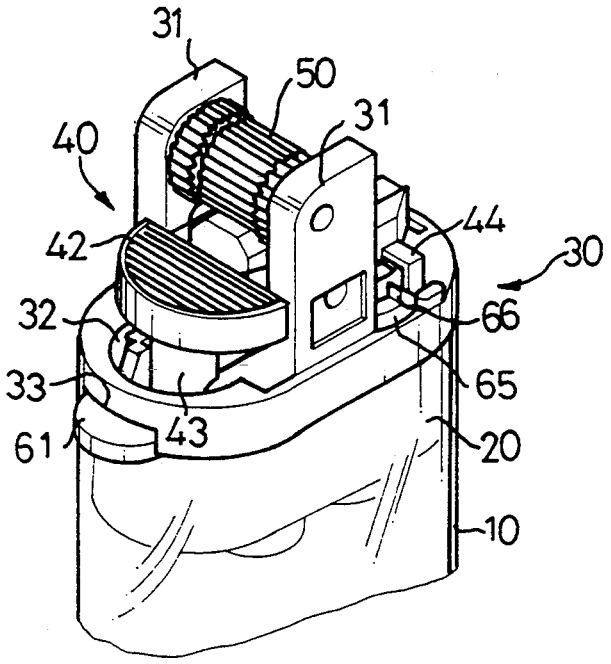
FIG. 1 is a partial perspective view of a lighter with a safety device in accordance with the present invention.
Figure 2:
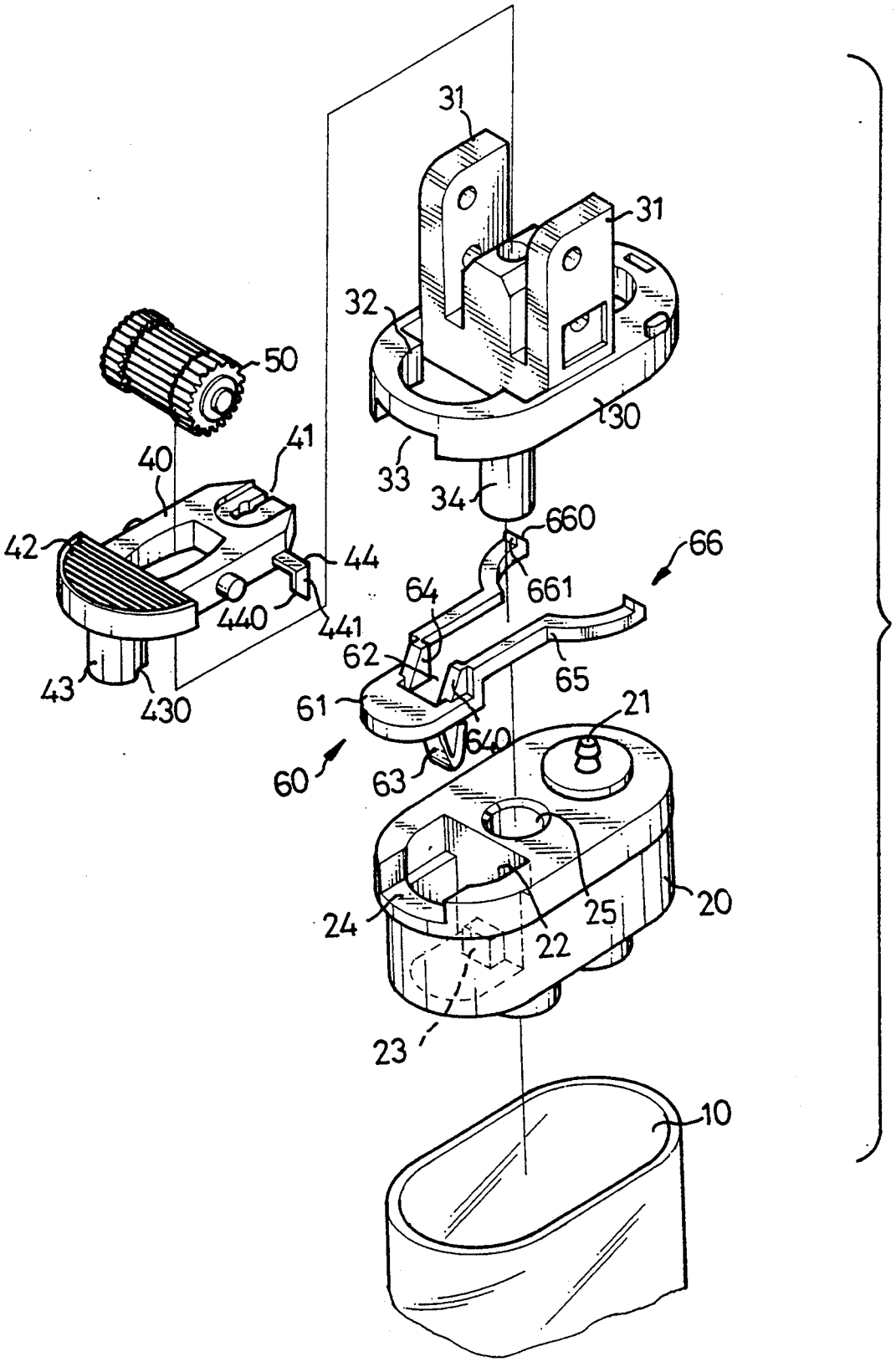
FIG. 2 is an exploded view of the lighter in FIG. 1.

Referring to FIGS. 1 and 2, a lighter generally includes a container 10 for containing liquefied gas therein, a base 20 mounted on top of the container 10 to seal the latter and having a nozzle with a nozzle mounted therein head 21 protruding upwardly therefrom to control the supply of the liquefied gas, a cap 30 mounted above the base 20 with a rod 34 thereof received in a central hole 25 in the base 20 and including a pair of ears 31 for rotatably mounting a flint wheel 50, and a lever means 40 pivotally mounted to the ears 31 and having a first end 41 engaging with the nozzle head 21 and a second end 42 on which the user may press to pull the nozzle head 21 upwardly to control the opening and closing of the nozzle. The above structure and operation thereof are conventional and are thus not further described.

The present invention is featured in the safety device including a safety member 60 and corresponding provisions on the base 20, the cap 30, and the lever means 40.

The base 20 includes a compartment 22 formed in a second end thereof opposite to a first end thereof where the nozzle 21 locates, a block 23 formed in the compartment 22, and a recess 24 formed in the second end of the base and communicating with the top of the compartment 22. The lever means 40 includes a safety piece 43 extending downwardly from an underside of the second end 42 and having a beveled surface 430 facing the first end 41 thereof. The lever means 40 further includes an L-shaped engaging member 44 having a horizontal section laterally projecting from each of two sides of the first end 41, each vertical section 441 of the engaging member 44 extending downwardly from the horizontal section and having a beveled surface 440 facing the second end 42. The cap 30 includes a passage 32 formed in one end thereof for communicating with the compartment 22 and includes a second recess 33 in an underside of said end.

The safety member 60 is mounted between the base 20 and the cap 30 includes a substantially U-shaped pressing section 61 whose mediate section is received in the recess 24 in the base 20 and the recess 33 in the cap 30, a stop 64 is formed on each of the pair of parallel ends of the pressing section 61, defining a slot 62 therebetween. Each stop 64 has a beveled surface 640 facing the pressing section 61 for detachably engaging with the beveled surface 430 of the safety piece 43, which will be described later. A substantially J-shaped flexible member 63 projects downwardly from the pressing section 61 for cooperating with the block 23 in the compartment 22 to provide a returning force for the safety member 60. A yoke member 65 extends from each end of the U-shaped pressing section 61 and having a distal end 66 with a vertical surface 661 facing the pressing section 61 and with for slidably engaging with the beveled surface 440 of the engaging member 44 a beveled surface 660 facing opposite to the vertical surface 661.

Figure 3:
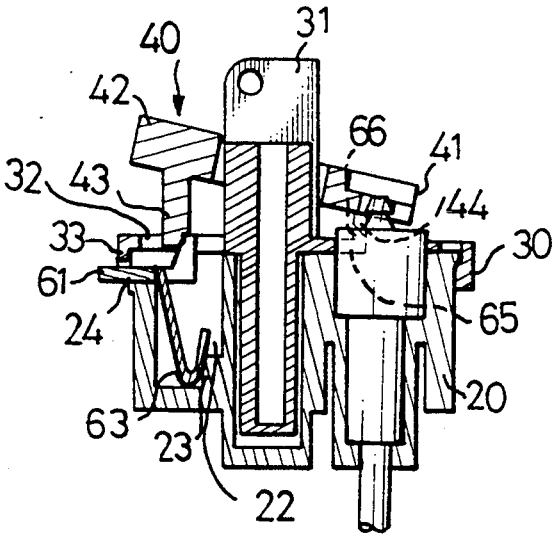
FIG. 3 is a cross-sectional view of the lighter in a locked position, the gas container being omitted for clarity.
Figure 4:
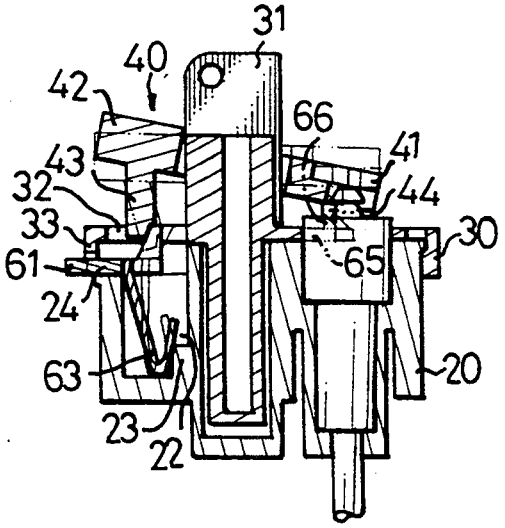
FIG. 4 is a view similar to FIG. 3, illustrating operation of the lighter.

Still referring to FIGS. 1 and 2 and further to FIG. 3 which shows a normal position of the lighter in which the flexible member 63 rests on the bottom of the compartment and contacts with the block 23, beveled surface 430 contacts with beveled surfaces 640 of the stops 64, and beveled surfaces 440 contacts with beveled surfaces 660, thereby prohibiting downward movement of the second end 42 of the lever means 40, and thus preventing from gas leakage.

If the user wants to use the lighter, he may urge the safety member 60 to move laterally toward the first end 41 of the lever means 40 upon laterally pressing the pressing section 61 for the beveled surface 660 to move forward relative to the beveled surfaces 440 such that the beveled surfaces 440 are slightly raised upward, so allowing the pressing section 61 to move toward the first end 41 of the lever means 40, and such that beveled surfaces 640 disengage from beveled surface 430, allowing downward movement of the second end 42 of the lever means 40 to perform the normal lighter function when in cooperation with rotation of the flint wheel 50. During the lateral movement of the safety member 60, the flexible member 63 is compressed in order to return the safety member 60 back to its normal position shown in FIG. 3 after the downward pressing force on the second end 42 of the lever means 40 is removed.

Although the invention has been explained in relation to its preferred embodiment in the form of a disposable lighter, it is to be understood that the safety device may also be applied to an electric lighter. Furthermore, many other possible modifications and variations can be made without departing from the spirit and scope of the invention as hereinafter claimed.

I claim:

1. A lighter comprising:

a container for containing liquefied gas therein, a base having a first end and a second end being mounted on top of the container, a nozzle mounted in the first end of the base and having a nozzle head protruding upwardly therefrom, a cap mounted above the base, and a lever means pivotally mounted to the cap and having a first end engaging with the nozzle head and a second end on which the user may press to operate the nozzle, the improvement comprising:

a compartment defined in the second end of the base, a block formed in the compartment, and a first recess defined in the second end of the base and communicating with a top of the compartment;

a safety piece extending downwardly from an underside of the second end of the lever means and having a first beveled surface facing the first end of the lever means, the lever means first including an L-shaped engaging member which has a horizontal section laterally projecting from each of two sides of the first end of the layer means, each engaging member having a vertical section which extends downwardly from the horizontal section and has second beveled surface facing the second end of the lever means;

the cap including a passage defined in one end thereof for communicating with the compartment and through which the safety piece of the lever means extends and including a second recess defined in an underside of the end; and a safety member mounted between the base and the cap and including a substantially U-shaped pressing section having a pair of ends which are parallel to each other and having a mediate section received in the first recess in the base and the second recess in the cap, a stop formed on each of the pair of parallel ends of the pressing section, each of the stops having a third beveled surface facing the pressing section for detachably engaging with the first beveled surface of the safety piece, a flexible member projecting downwardly from the pressing section for cooperating with the block in the compartment to provide a returning force for the safety member, a member extending from each of the pair of parallel ends of the U-shaped pressing section and having a distal end with a fourth beveled surface facing opposite to the pressing section for slidably engaging with the second beveled surface of the engaging member;

whereby in a normal position of the lighter, the flexible member rests on a bottom of the compartment and contacts with the block, the first beveled surface of the safety piece contacts with the third beveled surfaces of the stops, and the second beveled surfaces of the engaging member contact with the fourth beveled surfaces of the distal ends, thereby prohibiting downward movement of the second end of the lever means, and thus preventing from gas leakage; and a lateral movement of the safety member toward the first end of the lever means upon laterally pressing the pressing section causes the third beveled surfaces of the stops to disengage from the first beveled surfaces of the safety piece, allowing downward movement of the second end of the lever means to perform the normal lighter function.

* * * * *